US005165606A

United States Patent [19]

Pelet

[11] Patent Number: 5,165,606

[45] Date of Patent: Nov. 24, 1992

[54] METHOD FOR OPERATING A PRESSURE ATOMIZATION NOZZLE

[75] Inventor: Claude Pelet, Windisch, Switzerland

[73] Assignee: Asea Brown Boveri, Ltd., Baden, Switzerland

[21] Appl. No.: 709,221

[22] Filed: Jun. 3, 1991

[30] Foreign Application Priority Data

Jun. 7, 1990 [CH] Switzerland ..... 1908/90-9

[51] Int. Cl.[5] ..... B05B 7/04; F23D 11/40

[52] U.S. Cl. ..... 239/427.3; 239/434

[58] Field of Search ..... 239/427, 427.3, 429, 239/432, 433, 434

[56] References Cited

U.S. PATENT DOCUMENTS

| | | | |
|---|---|---|---|
| 1,342,732 | 6/1920 | Anthony | 239/427.3 |
| 2,344,519 | 3/1944 | Nagel | 239/427.3 |
| 3,224,682 | 12/1965 | Paris | 239/427.3 |
| 3,251,393 | 5/1966 | Beach et al. . | |

FOREIGN PATENT DOCUMENTS

| | | | |
|---|---|---|---|
| 0321809 | 6/1989 | European Pat. Off. . | |
| 3118120 | 2/1982 | Fed. Rep. of Germany . | |
| 6505721 | 11/1966 | Netherlands . | |
| 81691 | 7/1919 | Switzerland | 239/427.3 |
| 168865 | 4/1934 | Switzerland | 239/427.3 |

*Primary Examiner*—Andres Kashnikow

*Assistant Examiner*—Karen B. Merritt

*Attorney, Agent, or Firm*—Burns, Doane, Swecker & Mathis

[57] ABSTRACT

During the operation of a pressure atomization nozzle, the liquid fuel spray cone from the nozzle (4) is mixed upstream of a first orifice (3) which is placed downstream of the nozzle (4) in the outflow direction with a gaseous medium (7). In this process, the said spray cone is struck radially and/or virtually radially by the gaseous medium (7). In the process, the original spray angle from the nozzle, which is about 40°, is reduced to less than half. For this purpose it is sufficient if the gaseous medium (7) has a pressure of 20 mbar. The new spray angle is preserved across the first orifice (3), a second orifice (2) being provided in the outflow direction if required, the said second orifice functioning on the same principle as the first, i.e. in the case of the second orifice too, the mixture already produced is struck radially and/or virtually radially by the remaining proportion of the gaseous medium which was not used at the first orifice (3). The spray cone of the mixture is altered between a solid cone and a hollow cone by altering the spacings (D) between the nozzle (4) and the front wall of the first orifice (3) and between the rear wall of the first nozzle (3) and the front wall of the second orifice (2). In the case of two orifices (3, 2), their swallowing capacity is to be kept approximately equal.

8 Claims, 1 Drawing Sheet

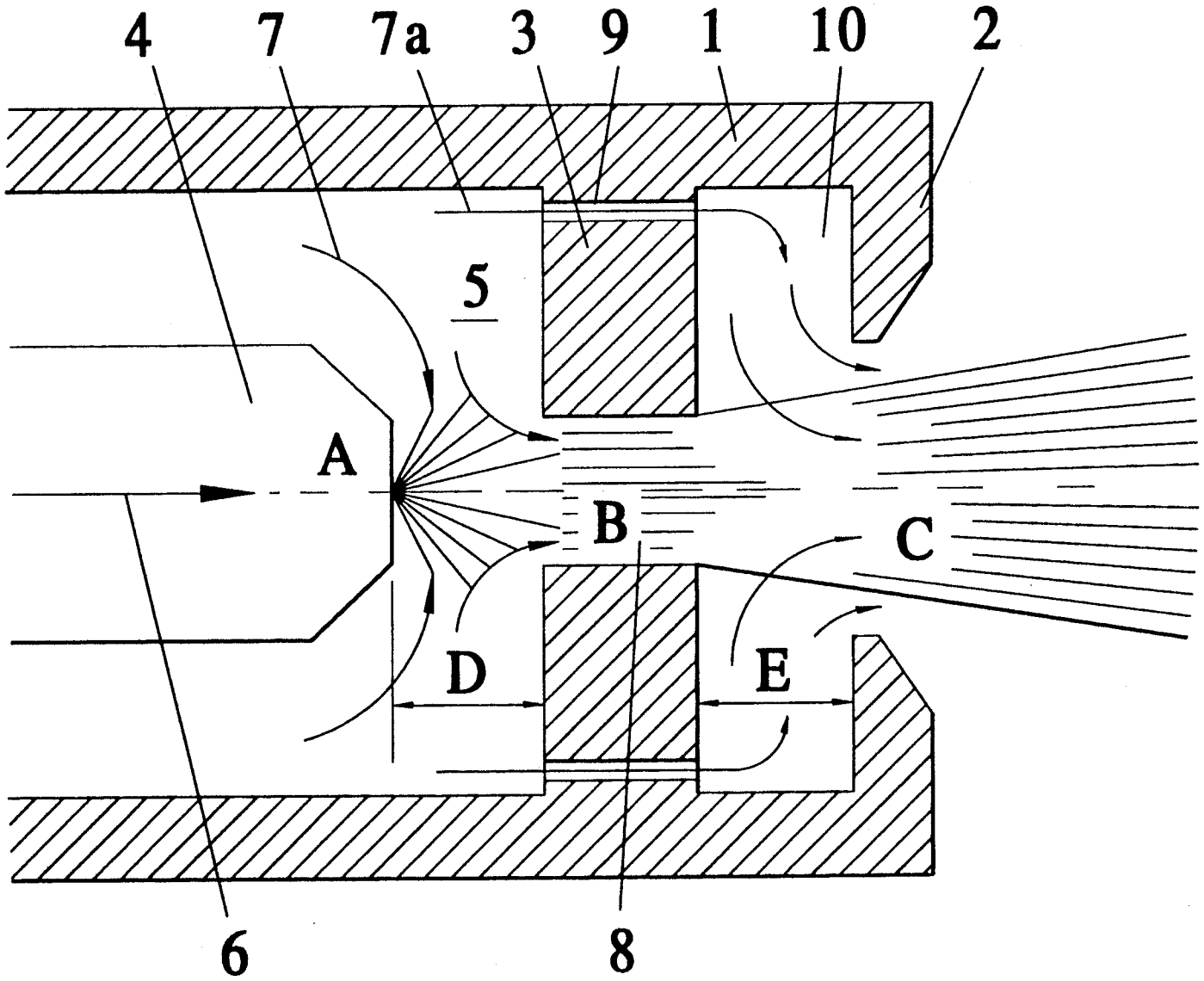
2
10
1
9
3
7a
7
4
5
A
B
C
D
E
8
6

METHOD FOR OPERATING A PRESSURE ATOMIZATION NOZZLE

BACKGROUND OF THE INVENTION

1. Field of the Invention

The present invention relates to a method for operating an atomization nozzle.

2. Discussion of Background

During pressure atomization of a liquid fuel in a nozzle which is placed upstream of a combustion space, for example a combustion chamber of a gas turbine or an atmospheric firing system, irregularities in the atomization characteristic of the nozzle regularly occur in the course of an operating period, said irregularities having a negative effect in terms of efficiency on the subsequent burning of the fuel. One irregularity can occur due to wear of the nozzle and can have the effect that the spray angle no longer operates in an optimum fashion. Another irregularity can be caused by the fact that the nominal pressure of the fuel supplied fluctuates inordinately, resulting in an expansion and contraction of the spray angle. In addition, the nozzles on the market produce an excessively large spray angle, of the order of 40°-50°, which is clearly at least 100% too much. Furthermore, such a nozzle operates very much as a function of the load range. If such a nozzle is then used in the atomization zone of a firing system with the ultimate end of providing a fuel/air mixture, this results in additional interference with the quality of atomization already attributable, for example, to pressure fluctuations of the air flow fed in. In addition, account must be taken of the fact that an air-assisted nozzle only functions at a pressure of 0.2 bar and above and that the air content in relation to the fuel is very high. An irregularity of the spray angle can in addition have a very negative effect in various firing units, whenever, for example, the atomization of the fuel is performed in a relatively narrow feed line leading to the firing space, as is often the case in premix burners. With such a geometrical configuration, an irregular spray angle can wet the inner walls of the premixing tube, where, in the case of a liquid fuel, relatively large fuel droplets rapidly form. If these are then taken along by the air flow, an inhomogeneous mixture reaches the firing space for combustion, leading to a poor firing characteristic. Not only is this noticeable in terms of poor efficiency, it also has a negative effect on pollutant emissions, such that it rapidly becomes impossible to comply with the legally prescribed maximum values. A further problem in this connection also arises when firing systems are to be operated whose air pressure is virtually non-existent, as is the case, for example, with atmospheric firing systems. In such cases, the prior art, i.e. the air-assisted nozzles which have been disclosed, are incapable of offering a satisfactory solution since an increase in the pressure of the air would here have to be specially produced, this having negative consequences for the costs and the efficiency of this same firing system.

SUMMARY OF THE INVENTION

It is here that the invention is intended to provide a remedy. It is an object of the invention as defined in the claims to avoid the disadvantages established above in a method for atomizing a fuel which serves for the preparation of a fuel/air mixture.

The essential advantages of the invention are to be seen in the fact that the spray angle can be minimized to such an extent that, on the one hand, there is no risk of wall wetting in the case of a corresponding configuration and that, on the other hand, once fixed, an atomization characteristic is retained unaltered. In this context, it proves advantageous that a variation of the spray quantity occurs without alteration of the spray angle. Furthermore, better fuel distribution in the mixture combustion cone can be achieved since it is possible to operate both with a solid cone and with a hollow cone, as required.

A further advantage of the invention is to be seen in the fact that, in atomization operation, the air employed for this purpose can be virtually unpressurized, i.e. in an atmospheric firing system, the pressure which the fan of the firing system is capable of providing, perhaps 20 mbar, is fully sufficient.

A further advantage of the invention is furthermore to be seen in the fact that any wear of the nozzle can no longer exert any influence on the atomization characteristic.

Advantageous and expedient further developments of the solution of the object in accordance with the invention are defined in the further claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing. All elements which are not required directly for the understanding of the invention have been omitted. The direction of flow of the various media has been indicated by arrows.

The single figure shows a double atomization nozzle.

DESCRIPTION OF THE PREFERRED EMBODIMENTS

Referring now to the drawing, the figure shows a double atomization nozzle comprising an outer tube 1 which ends in the outflow direction with an orifice 2. Provided upstream of the said orifice 2 is a further orifice 3 which, for its part, is positioned downstream of a fuel nozzle 4. The atomization of a liquid fuel 6 in accordance with the configuration under consideration is accomplished in two stages. It is nevertheless perfectly conceivable to dispense with one orifice, either with the first 3 or with the second 2. This depends essentially on the operating conditions of the atomization nozzle as a whole where the use of such a nozzle is envisaged as regards the combustion chamber (atmospheric firing system, combustion chamber of a gas turbine group, isochoric combustion chamber etc.). In addition, the structure and the method of combustion (diffusion or premix combustion etc.) of the particular burner into which the nozzle is integrated plays a part. The nozzle 4, which is here designed for a liquid fuel, operates at pressures between 5 and 20 bar and is accordingly a pressure atomization nozzle. As the spray pattern at the outlet of the nozzle 4 shows, this is a first, customary atomization stage A, i.e. spray angles of over 40° are to be expected here. With such a precondition, it would be impossible to avoid at least one wetting of the walls of the air-carrying channel 5 by fuel droplets. The air 7 fed in by this channel 5 is here at a low pressure of between 20 and 80 mbar and comes from a fan of an atmospheric firing system in the case of heating boilers. This also means that the pressure atomization nozzle shown is preferably used in systems in which a liquid fuel is employed. However, this is not an indispensable precondition since, as will be seen below, such a nozzle can perfectly well be part of a burner, driven by a gaseous fuel, of a combustion chamber of a gas turbine group. As regards the burner which has already been mentioned several times, this nozzle is eminently suitable for integration into a burner such as that described in EP-Al-0 312 809. This European Patent Application referred to thus forms an integrated part of the present description. In such an attempted combination, the nozzle shown in FIG. 1 of EP-Al-0 312 809 at item 3 would be replaced by the double atomization nozzle described here. It is shown particularly clearly how extremely important it is that the inner walls of the partial-cone body are not wetted by the fuel spray cone from the nozzle. Returning to the double atomization nozzle of the present figure, it should furthermore be stated that although, as mentioned, the air 7 fed in has only a low pressure, it compresses the liquid-fuel spray cone from the nozzle 4. This occurs at as low a pressure as 20 mbar. This air flow here strikes the spray cone radially and/or virtually radially and forces its flow to flow off through a cylindrical aperture 8 placed centrally in the orifice 3. A homogeneous fuel/air mixture then forms in stage B. This stage then creates a modification of the angle of the spray cone which turns out to be far smaller than the original one from the nozzle 4. The atomization of the fuel 6 in this stage B is largely independent of the quality of atomization provided in the preceding stage A. The cross-section of the aperture 8 is designed in such a way that it is capable of swallowing about 50% of the air fed in through the channel 5. The remaining proportion of the air flows directly through a number of passages 9, which are provided in the nozzle 3, into a chamber 10 which is situated downstream of the above-mentioned nozzle and widens between the rear wall of the first nozzle 3 and the front wall of the second nozzle 2. It is important here that the total cross-section of all the passages 9 has a sufficiently large swallowing capacity for the medium and, on the other hand, these passages 9 must be arranged in such a way that, as far as possible, they are placed on an outer diameter of the orifice 3 in order to obtain a radial and/or virtually radial flow of the air 7*a* to the new spray cone of the mixture in the chamber 10 as well. In stage C, a further mixing of the mixture formed prior to this in stage B thus takes place, this stage C primarily fulfilling the object of definitively atomizing any droplets of the liquid fuel 6 in the wake of the preceding stage B and, furthermore, of bringing about a further direction of the spray cone in the axial direction. Accordingly, this atomization nozzle makes possible very small angles of the spray cone, of the order of less than 20°, the atomization achieving a very high degree of homogeneity, this being extremely important for the subsequent combustion as regards pollutant emissions and the efficiency of the system. This atomization is also largely independent of the wear of the components of the double atomization nozzle as a whole. With this configuration, this nozzle can also be cooled and screened in an optimum way, should this be necessary in the particular application. Both in partial-load operation and in the case of shutting off of the fuel supply, even the last droplets are atomized equally well. By altering the spacing D between the front of the nozzle 4 and the front wall of the first orifice 3 and the spacing E between the rear wall of the first orifice 3 and the front wall of the second orifice 2, it is possible to alter the spray cone in stage C, depending on the size of the fuel droplets, to form a hollow cone or a solid cone. A mixed operating mode can be readily performed with the double atomization nozzle under consideration: the air flow 7 can be mixed with a proportion of a gaseous fuel and, indeed, it is even channel 5. This double atomization nozzle is furthermore eminently suitable for mixing the air 7 fed in with a proportion of recirculated exhaust gas. This exhaust gas recirculation is eminently suited to the reduction of exhaust gas emissions in the case of close-to-stoichiometric operation.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of operating a pressure atomization nozzle using liquid fuel comprising the steps of:

supplying a fuel spray cone from a fuel nozzle toward a first orifice disposed downstream of said fuel nozzle;

altering the distance between said fuel nozzle and said first orifice to establish said fuel spray cone downstream of said first orifice as one of a hollow cone or a solid cone according to said distance;

mixing said fuel spray cone with a gaseous medium flowing through an outer tube surrounding at least a portion of said fuel nozzle, said mixing occurring upstream of said first orifice; and supplying said gaseous medium substantially radially to said spray cone during said mixing step such that an initial spray angle of said spray cone is reduced.

2. A method of operating a pressure atomization nozzle according to claim 1, wherein said gaseous medium is supplied substantially radially to said fuel spray cone such that downstream of said first orifice said fuel spray cone has a spray angle of less than 20 degrees.

3. A method of operating a pressure atomization nozzle according to claim 1, wherein said gaseous medium is supplied to said fuel spray cone at a pressure of about 20 mbar.

4. A method of operating a pressure atomization nozzle according to claim 1, wherein said gaseous medium is air.

5. A method of operating a pressure atomization nozzle according to claim 1, wherein said gaseous medium is gaseous fuel.

6. A method of operating a pressure atomization nozzle according to claim 1, wherein said gaseous medium is a proportion of recirculated exhaust gas.

7. A method of operating a pressure atomization nozzle according to claim 1, comprising the step of further mixing said fuel spray cone with said gaseous medium at a location upstream of a second orifice and downstream of said first orifice;

supplying said gaseous medium at said location upstream of a second orifice and downstream of said first orifice substantially radially to said fuel spray cone during said further mixing such that said reduced spray angle is substantially maintained.

8. A method of operating a pressure atomization nozzle according to claim 7, wherein said fuel spray cone downstream of said second orifice is a hollow cone or a solid cone according to a distance between said first and second orifices and said distance between said first orifice and said fuel nozzle.

* * * * *